US007789734B2

(12) United States Patent
Swift et al.

(10) Patent No.: US 7,789,734 B2
(45) Date of Patent: Sep. 7, 2010

(54) MULTI-ORIFICE FLUID JET TO ENABLE EFFICIENT, HIGH PRECISION MICROMACHINING

(75) Inventors: Joseph A. Swift, Ontario, NY (US); Stanley J. Wallace, Victor, NY (US); Roger L. Bullock, Webster, NY (US); Fa-Gung Fan, Fairport, NY (US)

(73) Assignee: Xerox Corporation, Norwalk, CT (US)

( * ) Notice: Subject to any disclaimer, the term of this patent is extended or adjusted under 35 U.S.C. 154(b) by 0 days.

(21) Appl. No.: 12/163,380

(22) Filed: Jun. 27, 2008

(65) Prior Publication Data

US 2009/0320661 A1 Dec. 31, 2009

(51) Int. Cl.
*B24C 5/04* (2006.01)

(52) U.S. Cl. ..... 451/102

(58) Field of Classification Search ..... 451/102
See application file for complete search history.

(56) References Cited

U.S. PATENT DOCUMENTS 2,869,290 A * 1/1959 Stokes ..... 451/102
3,109,262 A * 11/1963 Weaver et al. ..... 451/76
4,001,945 A 1/1977 Aurich et al.
4,043,486 A 8/1977 Wisbey
4,125,969 A * 11/1978 Easton ..... 451/39
4,133,854 A 1/1979 Hendricks
4,141,701 A 2/1979 Ewan et al.
4,142,571 A 3/1979 Narasimhan
4,163,637 A 8/1979 Hendricks
4,221,257 A 9/1980 Narasimhan
4,221,335 A 9/1980 Shames et al.
4,331,739 A 5/1982 Narasimhan
4,474,251 A 10/1984 Johnson, Jr.
4,478,368 A * 10/1984 Yie ..... 451/102
4,624,193 A 11/1986 Johnston
4,681,264 A 7/1987 Johnson, Jr.
4,716,849 A 1/1988 Conn et al.
4,765,540 A * 8/1988 Yie ..... 239/8
4,768,709 A * 9/1988 Yie ..... 451/102
4,817,874 A 4/1989 Jarzebowicz
4,832,266 A 5/1989 Marvin
4,836,455 A 6/1989 Munoz
4,848,671 A 7/1989 Saurwein
4,945,073 A 7/1990 Dubensky et al.
4,951,429 A 8/1990 Hashish et al.
5,232,155 A 8/1993 Chen
5,421,517 A * 6/1995 Knudson et al. ..... 239/225.1
5,524,660 A 6/1996 Dugan
5,577,293 A 11/1996 Meredith et al.
5,737,709 A 4/1998 Getty et al.
5,848,753 A 12/1998 Wands et al.

(Continued)

FOREIGN PATENT DOCUMENTS

EP 0 437 168 12/1990

(Continued)

*Primary Examiner*—Maurina Rachuba
(74) *Attorney, Agent, or Firm*—MH2 Technology Law Group LLP

(57) ABSTRACT

A fluid jet based micromachining device and method include a workpiece, and fluid jets directing synchronized forces at the workpiece so as to converge forces at a dynamic contact zone on the workpiece and provide mechanical support to the workpiece during periods of contact with the fluid jets.

12 Claims, 5 Drawing Sheets

U.S. PATENT DOCUMENTS

| | | | | |
|---|---|---|---|---|
| 5,852,076 | A | 12/1998 | Serafin et al. | |
| 5,938,490 | A | 8/1999 | Rodler | |
| 5,980,372 | A | 11/1999 | Spishak | |
| 6,019,799 | A | 2/2000 | Brown et al. | |
| 6,051,630 | A | 4/2000 | Serafin et al. | |
| 6,077,152 | A | 6/2000 | Warehime | |
| 6,161,769 | A | 12/2000 | Kircher et al. | |
| 6,190,726 | B1 | 2/2001 | Koskinen et al. | |
| 6,200,486 | B1 | 3/2001 | Chahine et al. | |
| 6,413,632 | B1 | 7/2002 | Pascoe et al. | |
| 6,488,221 | B1 | 12/2002 | McDonald | |
| D470,566 | S | 2/2003 | Sciulli et al. | |
| 6,601,783 | B2 | 8/2003 | Chisum et al. | |
| 6,626,871 | B1 | 9/2003 | Smoliarov et al. | |
| D480,783 | S | 10/2003 | Sciulli et al. | |
| 6,648,242 | B2 | 11/2003 | Rogers et al. | |
| 6,676,039 | B2 | 1/2004 | Lindsey et al. | |
| 6,802,826 | B1 | 10/2004 | Smoliarov et al. | |
| 6,887,291 | B2 | 5/2005 | Alford et al. | |
| 6,908,051 | B2 | 6/2005 | Michael | |
| 2001/0030245 | A1 | 10/2001 | Lindsey et al. | |
| 2002/0109017 | A1 | 8/2002 | Rogers et al. | |
| 2002/0175228 | A1 | 11/2002 | McDonald | |
| 2002/0182981 | A1* | 12/2002 | Bradshaw | 451/38 |
| 2002/0190144 | A1 | 12/2002 | Chisum et al. | |
| 2003/0132325 | A1 | 7/2003 | Michael | |
| 2005/0017091 | A1 | 1/2005 | Olsen et al. | |
| 2005/0087631 | A1* | 4/2005 | Ursic | 239/548 |
| 2005/0233682 | A1 | 10/2005 | Chisum et al. | |
| 2005/0279852 | A1 | 12/2005 | McDonald | |
| 2006/0124772 | A1 | 6/2006 | Pourdeyhimi et al. | |
| 2007/0063066 | A1 | 3/2007 | Vijay et al. | |

FOREIGN PATENT DOCUMENTS

| | | |
|---|---|---|
| WO | 93/07334 | 4/1993 |

* cited by examiner

MULTI-ORIFICE FLUID JET TO ENABLE EFFICIENT, HIGH PRECISION MICROMACHINING

FIELD OF THE INVENTION

The present invention generally relates to fluid jet processes, and more particularly to high precision machining and micromachining with multiple fluid jets.

BACKGROUND OF THE INVENTION

Waterjet based processes are common in the field of micromachining. In particular, it is known to impinge a waterjet on a workpiece to cut, mill and turn the workpiece, for example. When waterjet methodologies are used to fabricate small parts, (e.g., less than one inch thick), and from thin, soft, and/or flexible materials, mechanical forces exerted by the high pressure waterjet transmit to the surface of the workpiece. These forces cause problematic deflections, vibrations, bending, and sometimes torque, on the workpiece. This undesired movement of the workpiece can result in poor dimensional and cutting precision, Thus, the practice throughout the industry is to avoid waterjet processing in many cases where waterjet processes simply do not have the required capabilities to precisely process thin or flexible materials. Instead, other non-contact, process technologies such as laser-cutting, milling, turning, and the like are used. Further, many operators of waterjet processes characteristically run their processes at slower than desired speeds in attempts to overcome these force induced deflection problems. Otherwise, waterjet processes are preferred because they impart no heat to the workpiece, do not alter the chemical composition of the work surface, and are less costly.

In fluidjet processes such as waterjet -cutting, -milling or -turning, the material removal process that occurs can be described as a supersonic fluidic erosion process. It is the velocity of the stream as opposed to stream pressure that tears away microscopic pieces or grains of material from the workpiece. Pressure and velocity are therefore two distinct forms of fluid stream energy where velocity is the dominant parameter that correlates with the work that is done on the workpiece. When pure water is pressurized up to 60,000 pounds or more per square inch (psi) and forced through a tiny, pin-hole opening, it can generate a velocity that can cut a wide variety of materials including paper, plastic, metal, rubber and foam. When small amounts of abrasive particles, such as garnet, are mixed into the jet stream, the resulting "abrasive waterjet" can cut virtually any thickness of any hard material such as metal alloys, composites, ceramics, stone and glass.

Pure water that is pumped by a high pressure pump and flowing through narrow pipes can have sufficient energy to erode matter from a workpiece as a result of stream velocities enabled by a small gem based orifice. The gem based orifice is made from a hard jewel material, e.g. diamond, ruby, sapphire having a tiny thru-port therein, and the hole is supplied with fluid by plumbing tubing as is known in the art. The pressurized water passes through this tiny thru-port, thereby converting the pressure to an extremely high velocity. At approximately 40,000 psi the resulting stream that passes out of a typical gem based orifice is traveling at Mach 2. And at 60,000 psi the speed is over Mach 3. A diameter of a thru-port for a pure waterjet gem based orifice-ranges from 0.003 to 0.010 inch for typical cutting operations.

A gem based orifice (also known as a jewel orifice) with a single thru-port is the present design of nearly all known gem based waterjet orifices which in turn generate a single stream of fluid, with the opening size of the thru-port being the main factor determining the size of the resultant stream. The three most common types of gem based orifice materials include sapphire, ruby, and diamond. Each material has its own unique attributes. Sapphire is the most common gem based orifice material and is a man-made, single crystal jewel having a fairly good quality stream. A gem based sapphire orifice has a life, with good water quality, of approximately 50 to 100 cuffing hours. In abrasive waterjet applications, the sapphire's life is ½ that of pure waterjet applications. Sapphires typically cost between $15 and $30 each. Diamond has a considerably longer run life (800 to 2,000 hours) but is 10 to 20 times more costly. Diamond is especially useful where a 24 hour per day operation is required.

When cutting relatively thin materials (for example less than 1 inch thick and greater than about ⅛th inch thick), a conventional waterjet machine typically cuts parts having a tolerance ranging from ±0.003 to ±0.015 inch (0.07 to 0.4 mm). For very thin materials, for example less than ⅛ inch thick, this tolerance can increase substantially depending upon the material and can be 2 to 3 times as great or greater. However, the cutting speed must be reduced to obtain tolerances within this large range. For materials over 1 inch thick, known machines will produce parts having dimensional tolerances from about ±0.005 to 0.100 inch (0.12 to 2.5 mm). Again, very slow cutting speeds must be used to cut these thicker materials. Thus, when very tight tolerances (for example <10 microns) are required regardless of the workpiece thickness and specifically when tight tolerances and fast process speeds are desired, the waterjet process in general is challenged.

It is the inventors' discovery that a large part of the problem with using high velocity gem based orifices lies with the imbalance of forces exerted by a single waterjet upon the workpiece. The combination of (primarily) velocity and (secondarily) pressure exerted by a waterjet downwards (or sideways) upon the surface of a workpiece can result in a force vertical or normal to the surface that falls within the range of about 0.5 to >5.0 pounds. Because the waterjet is translated into the side of, for example a rotating workpiece such as a rotating rod or pipe, there can be a second force vector that is in this same force range but orthogonal to the initial force vector. This force (orthogonal to the first force vector) can be sufficient in magnitude to generate bending, deflection, and/or vibration in that plane of the workpiece. Unfortunately, both force vectors from a single waterjet stream can work in concert to dynamically move the workpiece away from the waterjet in a manner that varies with time and process conditions. The effect is that the forces unpredictably move the workpiece away from an ideal contact region of the waterjet and are particularly problematic to materials that can deflect easily such as thin or flexible materials, which otherwise would be ideal candidates for waterjet processing. In addition, instabilities can exist within the flowing fluid that can also impart vibration to many materials, particularly to thin materials. Sufficient support must therefore be provided to (usually the underside and sidewalls of) the workpiece such that the forces and flow instabilities do not cause unacceptable movement or vibration in the workpiece.

In the case of thin rod-shaped rotating workpieces, it was discovered that the additional level of mechanical support required to fully prevent deflection and vibration resulted in a high level of torque being transmitted to the rotating workpiece. This additional mechanical support caused other unwanted, i.e. twisting-mode, distortions and related vibrations within the workpiece. In order to address these problems, the exemplary embodiments herein provide a low and no drag means to provide support and therefore to prevent deflection of the workpiece. The concept shown and described herein utilizes balancing forces and force distribution applied against the workpiece, in particular using at least two fluid jet streams during dynamic contact with the workpiece.

Furthermore, a third, but related problem also exists. When the waterjet is cutting through the workpiece, the waterjet stream will often deflect or disturb the jet coherency causing a decrease in the cutting power of the stream. This problem is referred to as "Beam Deflection" or "Stream Lag" and results in increased taper, inside corner problems, sweeping out of arcs and slower overall process speeds. The exemplary embodiments herein can favorably resolve this problem as well.

The embodiments described herein overcome these and other problems of the art by enabling high precision, multi-orifice fluid jet based micromachining.

SUMMARY OF THE INVENTION

In accordance with the present teachings, a fluid jet based micromachining device is provided.

The exemplary device can include a workpiece and multiple fluid jets, emitted from at least one gem based orifice, directing synchronized forces at the workpiece so as to provide mechanical support and force distribution to the workpiece during periods of contact with the fluid jets.

In accordance with the present teachings, a method of manipulating multiple fluid jets with respect to a workpiece is provided.

The method can include directing synchronized fluid jets with opposing forces at the workpiece to converge forces at a dynamic contact zone on the workpiece and thereby provide mechanical support to the workpiece during periods of contact with the fluid jets.

In accordance with the present teachings, a method of manipulating multiple fluid jets with respect to a workpiece is provided.

The exemplary method can include directing spaced parallel fluid jets emitted from a common complex gem based orifice into engagement with a workpiece from a first direction and in at least two locations on the workpiece to perform a first work operation, and directing the spaced parallel fluid jets in a second direction different from the first direction to perform a second work operation.

It is to be understood that both the foregoing general description and the following detailed description are exemplary and explanatory only and are not restrictive of the invention, as claimed.

The accompanying drawings, which are incorporated in and constitute a part of this specification, illustrate several embodiments of the invention and together with the description, serve to explain the principles of the invention.

DESCRIPTION OF THE EMBODIMENTS

Reference will now be made in detail to the exemplary embodiments of the invention, examples of which are illustrated in the accompanying drawings. However, one of ordinary skill in the art would readily recognize that the same principles are equally applicable to, and can be implemented in devices other than fluid jet micromachining methods and devices, and that any such variations do not depart from the true spirit and scope of the present invention. Moreover, in the following detailed description, references are made to the accompanying figures, which illustrate specific embodiments. Electrical, mechanical, logical and structural changes may be made to the embodiments without departing from the spirit and scope of the present invention. The following detailed description is, therefore, not to be taken in a limiting sense and the scope of the present invention is defined by the appended claims and their equivalents. Wherever possible, the same reference numbers will be used throughout the drawings to refer to the same or like parts.

Embodiments pertain generally to fluid jet micromachining methods and devices, and more particularly to use of at least two fluid jets therein. The at least two fluid jets can originate from separate gem based orifice structures or from a complex (multi-port) gem based orifice structure. Although the embodiments are described in connection with structures for jetting "fluid", it will be appreciated that the fluid can be pure water, abrasive water, ink, biologic fluid, industrial fluid, or chemical fluid, by way of non-limiting examples. Further, although the "workpiece" is generally depicted as a cylindrical (rod shaped) workpiece, it will be appreciated that the workpiece can be any known workpiece for which fluid jet micromachining is applicable.

Figure 1:
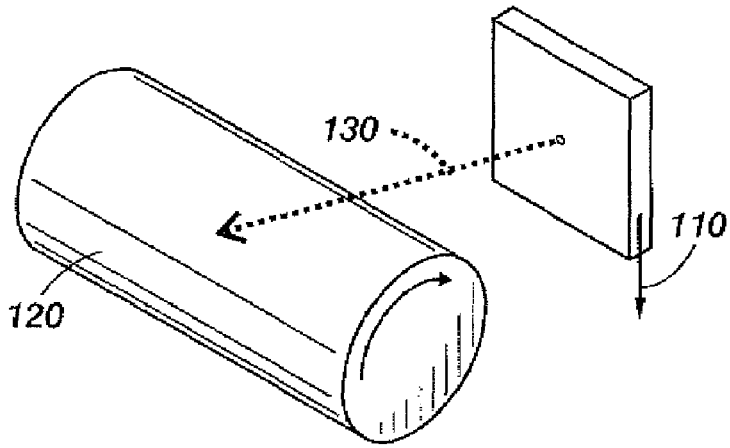
FIG. 1 (PRIOR ART)
FIG. 1 depicts a known relationship of a single fluid jet relative to a cylindrical workpiece.

FIG. 1 illustrates a conventional positional relationship between a single fluid jet stream 110 and a circular, rotating, rod-shaped workpiece 120. Although not depicted, the workpiece 120 is clamped at one end by jaws of a rotating collet or the like. The rotating collet rotates the workpiece, for example, in a clockwise direction. Typically, the single fluid jet stream 110, having a fluid stream in the direction of the arrow, intercepts an edge of the workpiece 120 along a movement path 130. This movement path 130 will cause the single fluid jet stream 110 to intercept the workpiece 120 at a predetermined location. The forces transmitted to the workpiece 120 by the fluid jet stream 110 are sufficient to cut into the workpiece. However, as described above, the forces will also deflect the workpiece 120 in a direction away from the fluid jet stream 110 and typically in a direction of the movement path 130. Aside from any resistance provided by the clamped end of the workpiece and any structural rigidity of the workpiece itself, there is no counter resistance to the applied single fluid jet force.

In order to overcome the deficiencies of known single fluid jet stream configurations, the exemplary embodiments herein utilize multiple, high pressure fluid jets. The multiple fluid jets can be emitted from at least a pair of single thru-port gem based orifices oriented to counterbalance each other, however multiple jets can be provided with streams generated from multiple thru-ports of a complex gem based orifice. The exemplary device and method can be used in a wide variety of fluid jet machining processes, and particularly in micromachining processes, to enable precise management of the deleterious forces observed in conventional waterjet machining, thereby improving both speed and precision.

In an exemplary embodiment, at least two fluid jets are positioned and/or moved in a complimentary manner in reference to a critical datum on a workpiece. The critical datum is that point on the workpiece where forces generated by at least the leading edges of the individual fluid jet streams are aligned in a generally opposing direction. This orientation of opposing fluid jet streams can offset any deflection that would otherwise occur in the workpiece. In addition, because more than one fluid jet stream is used in the exemplary embodiments, a speed of an overall micromachining process can be increased significantly, by a factor of about two or more times a previously known speed.

In a further exemplary embodiment, at least two parallel and synchronized fluid jet streams are positioned and/or moved to track along a common path. The parallel fluid jet streams can initially impinge an edge of a workpiece in a common first movement path of a first direction, and then move in a common second movement path of a second direction along the workpiece different from the first direction. Likewise, the parallel fluid jet streams can be initially moved into a position in a common first movement path at an end of the workpiece, and then move in a common second movement path of a second direction along the workpiece different from the first direction. The second option enables work on the workpiece from a distal end inward whereas the first option can enable work on the workpiece starting at a position interior of a length (for example) of the workpiece. The parallel fluid jet streams can further be oriented about an axis of the complex orifice (and corresponding nozzle) to adjust an effective distance between the fluid jets, thereby enabling control over a cut dimension and finish on the workpiece In the following, it will be appreciated that an exemplary workpiece is a cylindrical rod shaped workpiece. However, other shaped workpieces can be used in the exemplary embodiments, including angular, square, rectangle, prism and virtually any known shaped workpiece. Depiction of exemplary workpieces is limited in the drawings for simplicity, and is not intended to limit the scope of the invention.

Figure 2:
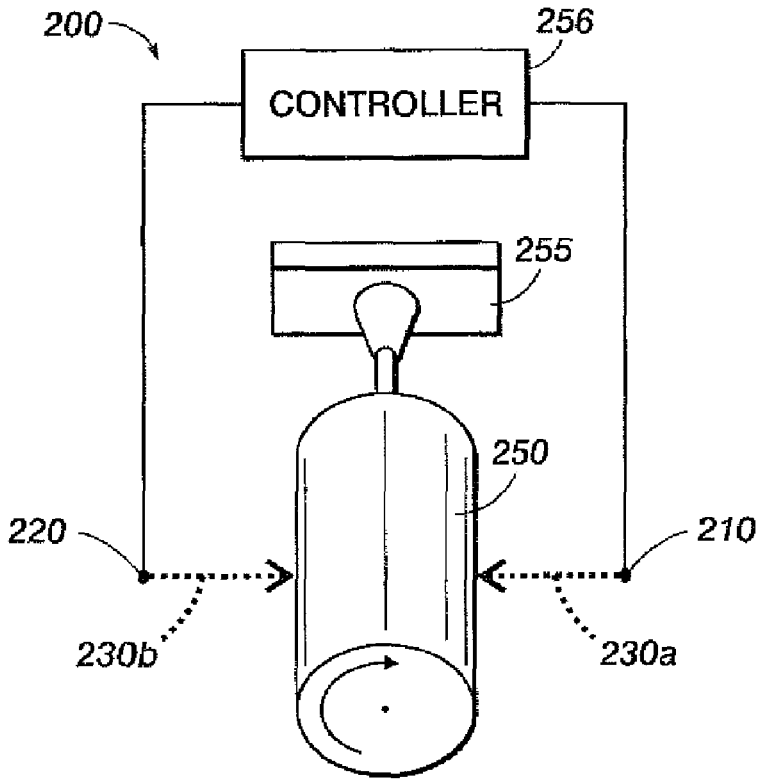
FIG. 2 is a perspective view of a multiple fluid jet device positioned relative to a cylindrical workpiece in accordance with embodiments of the present teachings.

Referring first to FIG. 2, an exemplary multi-port fluid jet embodiment 200 includes at least a first fluid jet stream 210 and second fluid jet stream 220, each fluid jet stream acting on an opposing surface (e.g. side, edge) of a workpiece 250. The first 210 and second 220 fluid jet streams are synchronized and opposing as indicated at 230*a*, 230*b* such that each fluid jet stream simultaneously contacts an opposing surface of the workpiece 250. The surface contact on the workpiece 250 is selected such that lateral forces of the fluid jet streams 210, 220 are approximately equal in magnitude and opposite in direction. When the fluid velocities are equal in magnitude and opposite in direction, the forces acting on the workpiece 250 can remain in balance. The fluid jets 210, 220 can perform, for example, a cutting action on the workpiece 250. In some embodiments, the workpiece 250 can be rotated, for example in a clockwise direction as depicted by the arrow therein. In some embodiments, the workpiece can be supported at one end by a device 255 such as by jaws of a rotating collet or the like, the rotating collet rotating the workpiece during a micromachining operation as known in the art.

The opposing fluid jet forces 230*a*, 230*b* acting on the workpiece 250 are each individually sufficient to cut into or perform some work function to the workpiece. Thus, the rate of cutting, for example with the opposing fluid jet streams, can be at least twice as fast as a single fluid jet stream and without unacceptable deflection of the workpiece.

In FIG. 2, the individual fluid jets can originate from separate stream-defining gem based orifices, each having a single thru-port therein and housed in a corresponding nozzle (not shown for purposes of clarity). Adjustments and control of the fluid streams emitted from the gem based orifices can be performed by a controller 256 to adjust an incoming fluid source.

Each gem based orifice can provide a characteristic shape and size to the subject, high velocity stream. Details of the gem based orifice are further provided in connection with at least FIG. 4A, below.

Figure 3A:
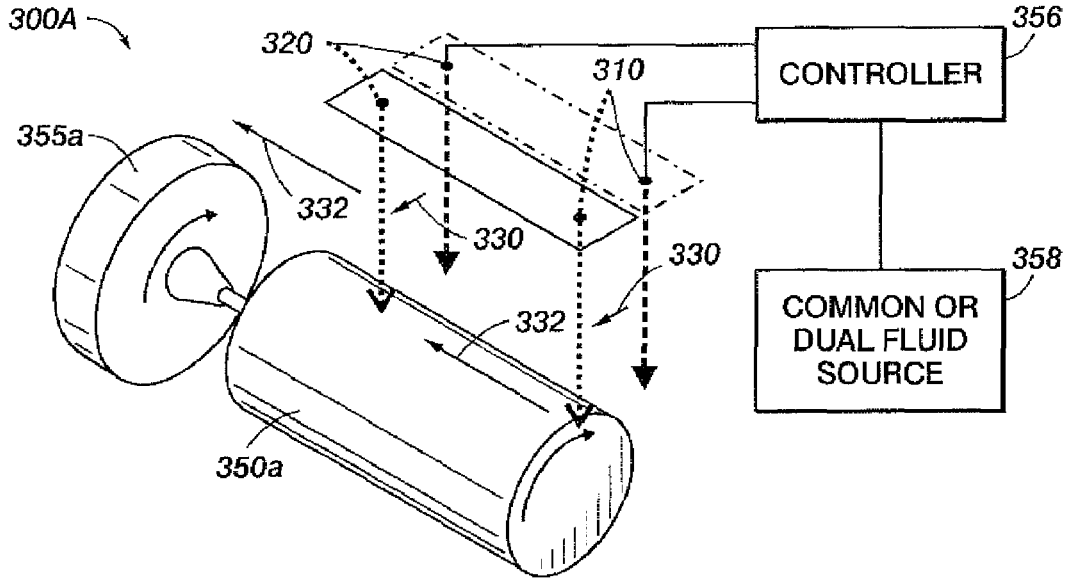
FIGS. 3A and 3B are perspective views of an alternative arrangement multiple fluid jet device positioned relative to a cylindrical and non-cylindrical workpiece, respectively, in accordance with embodiments of the present teachings.
Figure 3B:
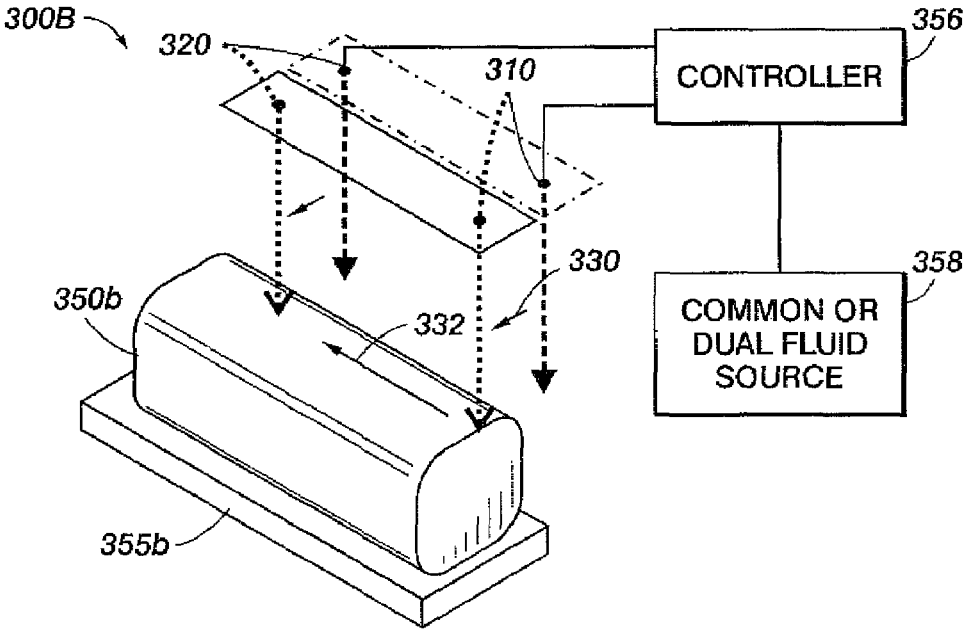

Referring now to FIGS. 3A and 3B, schematic diagrams illustrate exemplary multi-port fluid jet embodiments 300A, 300B. In FIG. 3A, an exemplary workpiece is a cylindrical shape and in FIG. 3B, an exemplary workpiece is non-cylindrical and can be supported by a substantially planar support member 355*b*.

In the exemplary multi-port fluid jet configurations of FIGS. 3A and 3B, fluid jet streams 310 and 320 can interact with a workpiece 350*a* and 350*b*. It will be appreciated that the pair of fluid jet streams 310, 320, can be output from an inventive complex gem based orifice (see FIG. 4B below), and further that the complex orifice can be housed in a common nozzle (not shown). The complex gem based orifice can emit parallel fluid jet streams 310, 320 in a synchronous movement. As illustrated in FIG. 3A, the workpiece 350*a* can be clamped at one end by a device 355*a*, for example by jaws of a rotating collet or the like, the rotating collet rotating the workpiece during a micromachining operation. As illustrated in FIG. 3B, the workpiece 350*b* can be supported by a substantially planar support 355*b*.

In operation, and as depicted in FIG. 3A, fluid jet streams 310 and 320 work from opposite sides of a rotating workpiece, allowing a balance of forces. In FIG. 3B, the fluid jets can be on the same side of a supported fixed position or rotating workpiece to enable faster cutting and finishing cuts along the same path. In the case of a fixed workpiece, deflection is not a concern and a faster, more controlled cut process can be performed.

In FIG. 3B, the synchronized and parallel fluid jet streams 310) 320 are emitted from a common complex gem based orifice (such as 400B in FIG. 4B) and can move along at least two movement paths with respect to the workpiece 350*a* and 350*b*. A first movement path of the synchronized fluid jet streams 310, 320 is depicted at 330 and can be selected to intercept the workpiece 350*a*, 350*b* at, for example, two corresponding locations on a surface of the workpiece. A purpose of this first intercept of fluid jet streams with the workpiece can be to perform a cut into the workpiece. As such, the first movement path 330 can be maintained until a predetermined cut depth into the workpiece is reached or a predetermined first operation on the workpiece is complete. Although the synchronized fluid jet streams 310, 320 can intercept the workpiece on a common side of the workpiece, a distribution of force over a span of the workpiece corresponding to a distance between the fluid jet streams, can reduce deflection of the workpiece. It will also be appreciated that the interception of the workpiece can be from an opposite side of the workpiece, and further that complex gem based orifices can be positioned on opposing sides of the workpiece substantially preventing deflection of the workpiece.

Subsequent to a first or initial movement path 330, the synchronized fluid jet streams 310, 320 can move in a second movement path 332 different from the first movement path 330. Examples of the second movement path 332 can include that which is parallel, perpendicular, or at any angle to one of the axes of the workpiece 350*a*, 350*b* or to the first movement path 330. By way of example, if the workpiece 350*a* is a cylindrical rod, the second movement path 332 can be selected to mill a layer of material off of the workpiece, thereby reducing its diameter. Because the synchronized fluid streams 310, 320 can act on or erode the workpiece 350*a* at an identical rate, an overall process speed can be significantly increased. By way of further example, in either a cylindrical or non-cylindrical workpiece, the synchronized fluid streams 310, 320 can notch, undulate, and perform complex machining of the workpiece without having to duplicate a movement path in a subsequent cut or operation performed by the fluid jet streams. Specifically, dual functions can be obtained in a single pass along a workpiece, thereby significantly increasing a process speed of the device.

Further, in the exemplary embodiments of FIGS. 3A and 3B, the first movement path 330 and the second movement path 332 can carry both fluid jet streams 310, 320 over the same paths, thereby providing an exact alignment to the pair of fluid jet streams, improving both speed and precision of a machining or micromachining device. By way of example, the fluid jets 320 and 310 can be slightly rotated to decrease a distance between the fluid jets when the fluid jets first engage the workpiece in either of FIGS. 3A, 3B. The fluid jets can then be moved in direction 332 and then be adjusted again by rotating around a center point of the complex gem based orifice of FIG. 4B. The rotation decreases a gap between the fluid jets and the fluid jets can move again along path 332 or reverse along path 332. Such cycling and movement of the fluid jets can be performed until a desired dimension, shape, finish or the like is achieved.

Because the fluid jet streams 310, 320 move in synchronous paths, an additional benefit can be obtained by varying a velocity of, for example one fluid jet stream 310, with respect to another fluid jet stream 320. For example, a first or lead fluid jet stream 310 can be adjusted to perform a rough-cut or major cut function on the workpiece 350*a*, 350*b*, while another fluid jet stream 320 can be adjusted to perform a final, fine-finish cut or polish on the workpiece 350*a*, 350*b*. In addition, each of the fluid jet streams 310, 320 can be individually, simultaneously, sequentially, and alternately adjusted to control fluid diameter, penetration depth, stream velocity, and/or contact area on the workpiece. These adjustments can be performed by a controller 356 to adjust an incoming fluid source 358.

Figure 4A:
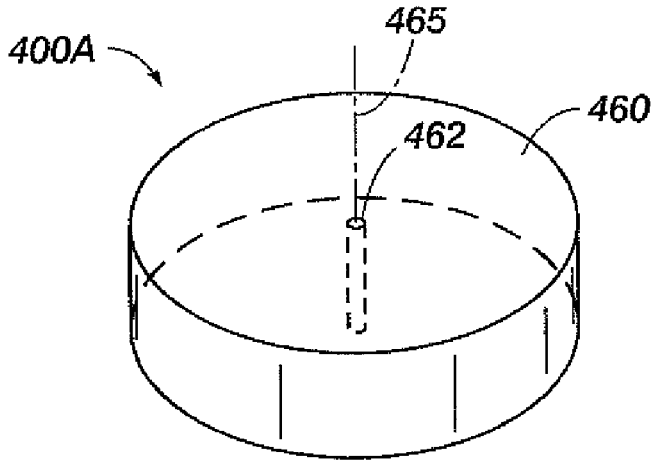
FIG. 4A is a perspective view illustrating an exemplary gem based orifice for use in accordance with embodiments of the present teachings.
Figure 4B:
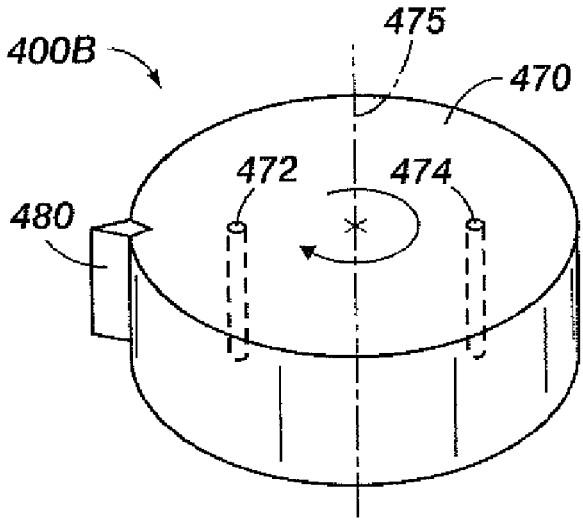
FIG. 4B is a perspective view illustrating an exemplary gem based complex (multi-port) orifice for use in connection with embodiments of the present teachings.

Referring now to FIGS. 4A and 4B, exemplary gem based orifice bodies 460 and 470, respectively, are provided for emitting the fluid jets 310, 320 described above. More specifically, gem based orifice bodies can include one 462 (FIG. 4A) or multiple 472, 474 (FIG. 4B) thru-ports formed therein. As known in the art, exemplary gemstones for the gemstone based orifice can include diamond, ruby, and sapphire.

The gem based orifice 400A of FIG. 4A can include the orifice body 460 having a longitudinal center axis 465, and a single thru-port 462 formed in the orifice body. As used herein, the term "port" can include any opening, aperture, slit, slot, etc. formed entirely through the orifice body, so as to enable passage of high velocity fluid therethrough. The gem based complex orifice 400B of FIG. 4B can include the orifice body 470 having a longitudinal center axis 475, and at least two thru-ports 472, 474 formed in the orifice body. It will be appreciated that the orifice body 470 can be any suitable shape having an identifiable longitudinal axis, and that the given shape is not intended to limit the scope of the invention.

In addition, the complex orifice 400B of FIG. 4B can include a reference tab or locator structure 480 incorporated in or on the complex orifice 400B to align with and determine a location of one or both fluid jet streams (see FIG. 3) exiting the thru-ports 472, 474 of the complex orifice. The reference tab 480 can be mated with a similar feature within a nozzle (not shown) such that the nozzle is precisely aligned with the thru-ports 472, 474 of the complex orifice 400B. By this arrangement, positioning and movement of the complex orifice 400B can be translated to the nozzle, and from the nozzle to the complex orifice. In turn, the nozzle can control the position of each of the multiple streams that originate at the complex orifice 400B. It is known in tooling applications to create alignment features and fiduciary marks to control and monitor precision positions of tool components, and such complementary control is intended to be included within the scope of the exemplary embodiments.

The thru-ports 472, 474 of the complex orifice 400B can include two identical small diameter holes (i.e. from about 0.002 to about 0.005 inches in diameter) to permit passage of high velocity fluid jet streams useful in machining workpieces. The thru-port holes 472, 474 can be equal in size, or narrower than, spacing between distinct high pressure fluid sources (not shown) supplied to the complex orifice. The narrower spacing between thru-ports 472, 474 relative to fluid supply can favor those cases where a sequence of fluid jet cutting and milling is used to produce a large number of identical parts from a rotating rod or a non-rotating workpiece.

A single fluid source (e.g. 358 in FIGS. 3A, 3B) can be used to supply high pressure fluid to the complex orifice 400B. Alternatively, narrow, high pressure piping (not shown) can be mated with suitable features on the upstream side of the complex orifice 400B such that each thru-port 472, 474 within the complex orifice 400B can be provided with a separate fluid source (e.g. 358 in FIGS. 3A, 3B). This enables control 356 of critical stream features (i.e. pressure, flow rate, fluid type, etc.) to be individually matched to the desired function to be performed by each fluid jet stream.

Returning to the exemplary embodiment of FIG. 2, the individual fluid jet streams 210, 220 can originate from separate, independently controllable sources that are linked in a suitable manner (for example by programmable controllers or similar control source 256) such that the outputs of each can be appropriately controlled and synchronized. This configuration can use the exemplary gem based orifice 400A as depicted and described in connection with FIG. 4A. The gem based orifice 400A can be housed in a suitable nozzle mounted at the end of an individually controllable manipulation arm, such as a 3-axis (i.e. x-y-z) robot arm (not shown). Suitable plumbing can be used to connect fluid nozzle to a high pressure pumping system as known in the art. This configuration can provide a nearly limitless range of control over the individual streams' velocity, positions, and movements, which would be best suited to those applications requiring a variety of process capabilities and versatility, such as would be the requirements of a short run shop.

Alternately, the exemplary embodiment of-FIGS. 3A, 3B can utilize the complex orifice 400B as depicted in FIG. 4B, enabling output of multiple fluid jet streams from the thru-ports of the single gem based complex orifice. In this embodiment, the complex gem-based orifice 400B can include two or more thru-ports 472, 474 which output multiple streams from a single gem based complex orifice. The complex orifice 400B can be housed in a single nozzle while at the same time each of the streams can be positioned relative to each other in a highly precise relationship.

By way of example, a rod type workpiece (e.g. 350*a* of FIG. 3A) can be aligned at a centerline 475 of the fluid jet streams (e.g. 310, 320) originating from the complex orifice 400B and spaced an appropriate stand-off distance from the nozzle (not shown) containing the complex orifice 400B.

Upon energizing a supply of high pressure water through appropriate plumbing to the thru-ports 472, 474 of the complex orifice 400B, two fluid jet streams (e.g. 310, 320 of FIG. 3A) exit the complex orifice at extremely high velocities, such as in the range of 2000 to 8000 feet per second. The position of the workpiece (e.g. 350*a*) between the two fluid jet streams (which travel parallel to one another at a separation distance approximately equal to the spacing distance between the small ports in the complex orifice). The synchronized fluid jet streams (e.g. 310, 320) emitted from the complex orifice 400B, can simultaneously intercept the workpiece (e.g. 350*a*), or can intercept the workpiece with one fluid stream (e.g. 320) leading another fluid stream (e.g. 310). The reference tab 480 can indicate the relative position of the two fluid jet streams (e.g. 310, 320) and the centerline 475 of the complex orifice 400B.

By rotating the complex orifice 400B around the centerline 475, the distance between the two thru-ports 472, 474 (and hence the output fluid jets 310, 320 of FIG. 3) becomes effectively narrower relative to an impact surface of the workpiece. Pivoting the complex orifice 400B further about the centerline 475 can further reduce the effective spacing between thru-ports 472, 474 and thus the emitted fluid jets, to a point where the final relative spacing determines a dimension of cut made into, for example, the rotating rod type workplace. Thus the depth of a cut into the workpiece can be determined by the position of the reference tab 480 which in turn controls the angular relationship of the thru-ports 472, 474 to the centerline 475 of the complex orifice 400B and thereby the stream's position to edges of the workpiece. If the dual fluid jet streams are moved into and then along the axial direction of the rotating rod shaped workpiece, the rod shaped workpiece can be milled or turned down in diameter to a diameter determined by the a final spacing distance between the fluid jet streams. As explained above, the lateral forces exerted by the individual streams are offset and minimized by a distribution of force over a span of the workpiece. Clearly, the net force that occurs in the lateral plane of movement into the rod can be close to zero in magnitude.

It will be further appreciated that fluid jet streams (e.g. 310, 320) emitted from thru-ports 472, 474, can be selectively adjusted individually or simultaneously. The selective adjustments can include flow or no flow, stream diameter, velocity, incidence angle, and the like.

Figure 5A:
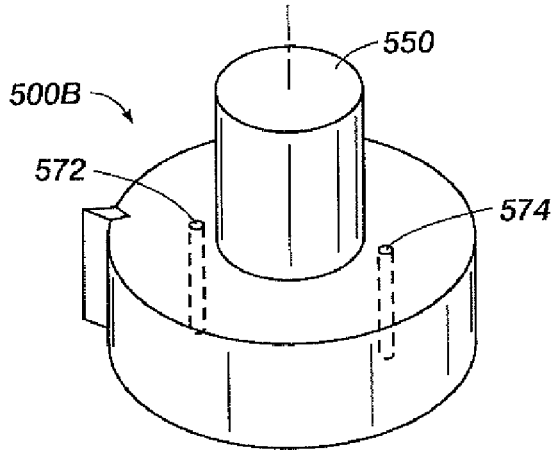
FIGS. 5A-5C depict various exemplary orientations of the complex orifice for use in connection with embodiments of the present teachings.
Figure 5B:
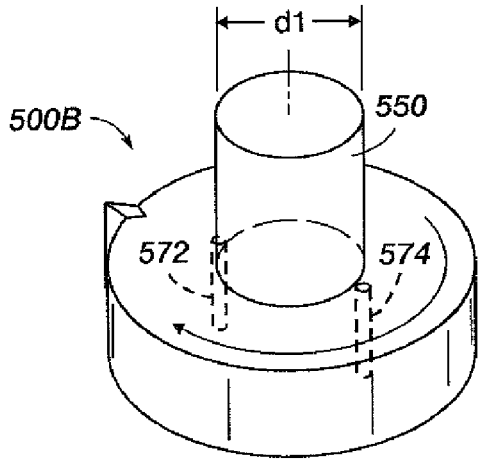
Figure 5C:
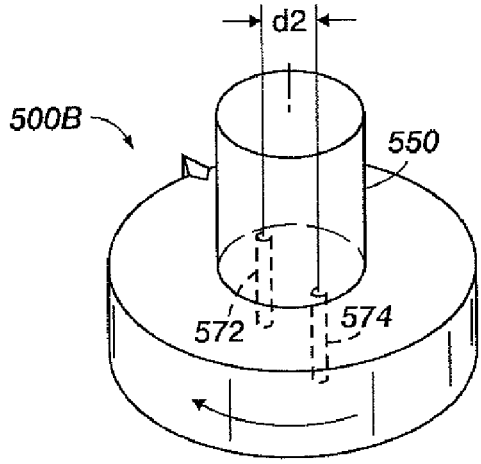

Examples of changing an effective distance between parallel thru-ports 472, 474 of complex orifice 400B, is depicted in corresponding parallel thru-ports 572, 574 and complex orifice 500B of FIGS. 5A-5C. It will be appreciated that the output fluid jet streams correspond to the position of the thru-ports. In FIG. 5A, thru-ports 572, 574 can be positioned such that the fluid jet streams can substantially straddle the workpiece 550 when set in motion along the second movement path (e.g. 332 of FIGS. 3A and 3B). In order to enable the fluid jet streams to cut, mill or otherwise engage the workpiece 550, the complex orifice 500B can be rotated, for example in a clockwise direction, by a predetermined amount. As depicted in FIG. 5B, the complex orifice 500B has been rotated by an amount sufficient for emitted fluid jet streams to just brush an outer surface of the workpiece 550. The rotation amount can result in an effective spacing distance d1 between the thru-ports 572, 574 relative to the workpiece 550. Such a positioning of the fluid jet streams can result in, for example, polishing a surface of the workpiece. As depicted in FIG. 5C, the complex orifice 500B can be rotated further, for example continuing in the clockwise direction, by a predetermined amount. As depicted in FIG. 5C, the complex orifice 500B can be rotated by an amount sufficient for emitted fluid jet streams to cut into a surface of the workpiece 550 by a predetermined depth. The rotation amount can result in an effective spacing distance d2 between thru-ports 572, 574. In addition to changing an effective spacing between the thru-ports and thus the fluid jet streams, further control can be achieved by varying a velocity, angle, diameter, port shape, and the like for the complex orifice 500B as described above.

Figure 6A:
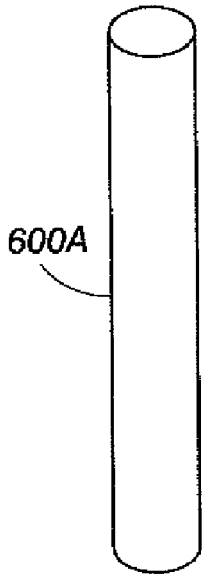
FIGS. 6A and 6B depict various port configurations in accordance with exemplary embodiments of the present teachings.
Figure 6B:
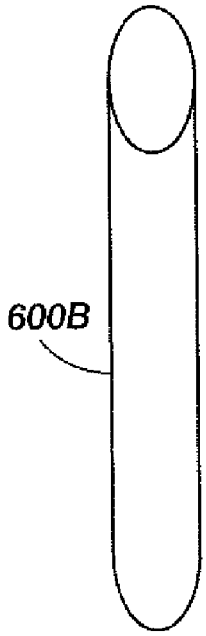

In other embodiments, one (or both) of the small thru-ports 462 of FIG. 4A, and thru-ports 472, 474 within the complex orifice 400B of FIG. 4B can be shaped as an oval, or slot, or other similar shaped thru-port hole(s). For example, one of the gem based orifices used in the embodiment of FIG. 2 can include one round 600A or one slot-shaped 600B thru-port as depicted in FIGS. 6A and 6B. Another of the gem based orifices of FIG. 2 can use a same or different shaped thru-port. Likewise the thru-ports in the complex orifice can include one round and one slot-shaped port hole such as that depicted in FIGS. 6A and 6B, respectively. Alternatively, both thru-ports can use the same or different shaped thru-ports.

Because material cutting occurs essentially at a narrow edge of the fluid stream, innermost edges of the hole and of the slot can serve as effective cutting surfaces, which are clearly smaller in area than an entire sectional area of the fluid jet streams. It is intended that the edge of the slot can be used as the reference for movement of the streams' positions instead of the centerline 475 of the complex orifice 400B as described above for all movement of the streams. For example, by holding the position of the slot stationary and rotating the hole towards this position, the spacing between the fluid jet stream emanating from the hole can move closer to the fluid jet stream originating from the slot. High cuffing and milling speeds can therefore be achieved with very high positional precision of the individual fluid jet streams. This can enable high process speeds, great dimensional precision and surface finishes (i.e. smoothness) that are not readily possible with conventional waterjet processes. The major and minor axes of the non-round port holes can occur at any desired orientation.

Thus, exemplary embodiments describing opposing fluid jet forces can significantly enhance desirable fluid jet processes of cutting, milling and turning of flexible or thin materials without the unwanted deflection that leads to tapered, irregular surfaced, or poor dimensional tolerances in final parts. The concept of complex orifices as the means to simplify delivery of multiple fluid streams which enable faster and more precise waterjet processes can revolutionize the waterjet industry. For example, waterjet turning of very small diameter rods made from composite plastics to selectively reduce the diameter or to incorporate features into the rods such as slots, notches, ring grooves, tapered sections, tapered ends, and the like can now become possible. Likewise, waterjet machining of non-cylindrical workpieces can also be enhanced at least by performing dual functions in a single pass of the workpiece, thus eliminating errors that can occur with multiple passes along a workpiece. This methodology can also be useful for placing micro machined features in the next generation of Scavengeless Electrode Donor (SED)

wires, Corotron, Scorotron or Discorotrons, where the challenge is to improve the developer wires as part of an attack in a series of serious problems that limits extensibility. Further, the use of precisely positioned and delivered multiple-jet streams as identified herein can enable a significantly faster fuser roil recovery/recycling process owing to the fact that the expended layer of rubber can be removed from the roll core at a faster pace thereby reducing the cost of fuser roll recovery/renewal manufacturing operations.

Although the relationships of components are described in general terms, it will be appreciated by one of skill in the art can add, remove, or modify certain components without departing from the scope of the exemplary embodiments.

While the invention has been illustrated with respect to one or more exemplary embodiments, alterations and/or modifications can be made to the illustrated examples without departing from the spirit and scope of the appended claims in particular, although the method has been described by examples, the steps of the method may be performed in a difference order than illustrated or simultaneously. In addition, while a particular feature of the invention may have been disclosed with respect to only one of several embodiments, such feature may be combined with one or more other features of the other embodiments as may be desired and advantageous for any given or particular function. Furthermore, to the extent that the terms "including", "includes", "having", "has", "with", or variants thereof are used in either the detailed description and the claims, such terms are intended to be inclusive in a manner similar to the term "comprising." And as used herein, the term "one or more of" with respect to a listing of items such as, for example, "one or more of A and B," means A alone, B alone, or A and B.

Notwithstanding that-the numerical ranges and parameters setting forth the broad scope of the invention are approximations, the numerical values set forth in the specific examples are reported as precisely as possible. Any numerical value, however, inherently contains certain errors necessarily resulting from the standard deviation found in their respective testing measurements. Moreover, all ranges disclosed herein are to be understood to encompass any and all sub-ranges subsumed therein. For example, a range of "less than 10" can include any and all sub-ranges between (and including) the minimum value of zero and the maximum value of 10, that is, any and all sub-ranges having a minimum value of equal to or greater than zero and a maximum value of equal to or less than 10, e.g., 1 to 5.

Other embodiments of the invention will be apparent to those skilled in the art from consideration of the specification and practice of the invention disclosed herein. It is intended that the specification and examples be considered as exemplary only, with a true scope and spirit of the invention being indicated by the following claims and their equivalents.

What is claimed is:

1. A fluid jet based machining device comprising:

a workpiece; and dual fluid jet streams, emitted from at a gem based orifice, the gem based orifice rotatable about an orifice centerline in order to reduce an effective spacing between the dual fluid jets with respect to the workpiece, the dual fluid jets rotatable around the orifice centerline to a point where a final relative spacing determines a dimension of cut made into the workpiece.

2. The device of claim 1, wherein each fluid jet treats a workpiece surface by one or more of a cut, mill, turn, roughen, peen, polish, and other fluidic erosions.

3. The device of claim 1, wherein the gem based orifice comprises a pair of parallel spaced thru-ports, each thru-port dispensing one fluid jet.

4. The device of claim 3, further comprising means for moving the complex gem based orifice relative to the workpiece in a first movement path and a second movement path different than the first movement path.

5. The device of claim 1, wherein each fluid jet comprises a different selected velocity for performing a predetermined work function on the workpiece.

6. The device of claim 1, wherein each fluid jet comprises adjustable factors including penetration depth, velocity, and diameter.

7. A method of manipulating fluid jets with respect to a workpiece, the method comprising:

directing spaced parallel fluid jets emitted from a common complex gem based orifice to intercept a workpiece from a first direction and in at least two locations to perform a first work operation on the workpiece;

directing the spaced parallel fluid jets in a second direction different from the first direction to perform a second work operation on the workpiece; and emitting a different selected velocity from each fluid jet.

8. The method of claim 7, wherein the gem based orifice is rotatable about an orifice centerline in order to reduce an effective spacing between the parallel fluid jets to a point where a final relative spacing determines a dimension of cut made into the workpiece.

9. The method of claim 7, wherein the second direction comprises a direction transverse to the first direction.

10. The method of claim 7, wherein the workpiece comprises a cylindrical body.

11. The method of claim 7, wherein the workpiece comprises a non-cylindrical body.

12. The method of claim 7, further comprising selectively actuating one or both fluid jets.

* * * * *